US008205271B2

(12) United States Patent
Canci

(10) Patent No.: US 8,205,271 B2
(45) Date of Patent: Jun. 26, 2012

(54) HOSIERY WITH REMOVABLE FOOT CUSHION

(76) Inventor: Ursula Canci, Staten Island, NY (US)

( * ) Notice: Subject to any disclaimer, the term of this patent is extended or adjusted under 35 U.S.C. 154(b) by 494 days.

(21) Appl. No.: 12/231,577

(22) Filed: Sep. 4, 2008

(65) Prior Publication Data

US 2010/0050320 A1 Mar. 4, 2010

(51) Int. Cl.
*A41B 11/00* (2006.01)
*A41B 17/00* (2006.01)

(52) U.S. Cl. ..... 2/239; 2/409; 2/267

(58) Field of Classification Search ..... 2/239, 240, 2/241, 409, 267, 242; 36/91, 140, 145, 150, 36/154, 155, 164, 165, 166, 169
See application file for complete search history.

(56) References Cited

U.S. PATENT DOCUMENTS

| | | | | | |
|---|---|---|---|---|---|
| 1,477,357 | A | * | 12/1923 | Jensen | 602/65 |
| 1,546,245 | A | * | 7/1925 | Luck et al. | 36/165 |
| 1,741,340 | A | * | 12/1929 | Scholl | 2/239 |
| 1,814,885 | A | * | 7/1931 | Aust | 66/182 |
| 2,600,864 | A | * | 6/1952 | Fuller | 36/164 |
| 2,771,691 | A | * | 11/1956 | Luchs | 36/10 |
| 2,790,975 | A | * | 5/1957 | McCormick | 2/239 |
| 2,878,593 | A | * | 3/1959 | Lockridge | 36/169 |
| 3,003,154 | A | * | 10/1961 | Litman | 2/239 |
| 3,266,058 | A | * | 8/1966 | Guttman | 2/239 |
| 3,334,356 | A | * | 8/1967 | Abel | 2/239 |
| 3,339,555 | A | * | 9/1967 | Rotko | 36/165 |
| 3,344,537 | A | * | 10/1967 | Diamant | 36/91 |
| 4,249,319 | A | * | 2/1981 | Yoshida | 36/2.6 |
| 4,277,959 | A | | 7/1981 | Thorneburg | |
| 4,445,233 | A | | 5/1984 | Rubin | |
| 4,841,648 | A | * | 6/1989 | Shaffer et al. | 36/43 |
| 4,926,568 | A | | 5/1990 | Coffman | |
| 5,092,347 | A | * | 3/1992 | Shaffer et al. | 128/892 |
| 5,133,091 | A | | 7/1992 | Del Valle Mas | |
| 5,230,333 | A | * | 7/1993 | Yates et al. | 607/111 |
| 5,329,640 | A | | 7/1994 | Hourigan | |
| 5,331,688 | A | * | 7/1994 | Kiyohara | 2/239 |
| 5,421,034 | A | * | 6/1995 | Keune | 2/239 |
| 5,651,142 | A | | 7/1997 | Del Valle Mas | |
| 5,671,482 | A | | 9/1997 | Alvera | |
| 5,768,713 | A | | 6/1998 | Crick | |
| 5,778,449 | A | * | 7/1998 | Oetting et al. | 2/16 |
| 5,791,163 | A | * | 8/1998 | Throneburg | 66/178 R |

(Continued)

FOREIGN PATENT DOCUMENTS

KR 10-2003-0070784 A 2/2003

(Continued)

OTHER PUBLICATIONS

English Translation of KR 2003-0070784; Lee.*

*Primary Examiner* — Alissa L Hoey
(74) *Attorney, Agent, or Firm* — Peter B. Sorell

(57) ABSTRACT

Footwear hosiery is provided, which includes a first layer defining a front portion, an arch portion and a rear portion. A second layer is connected with at least one of the arch portion and the front portion in a configuration to define a receptacle having an opening. A pad is configured for removable disposal within the receptacle. The first layer may be a fabric material. The second layer may be fabricated from a flexible material.

14 Claims, 5 Drawing Sheets

U.S. PATENT DOCUMENTS

| | | | | |
|---|---|---|---|---|
| 6,000,147 | A * | 12/1999 | Kellerman | 36/44 |
| 6,001,122 | A | 12/1999 | Lyles | |
| 6,275,997 | B1 * | 8/2001 | Richardson | 2/239 |
| 6,532,689 | B1 * | 3/2003 | Jones, Jr. | 36/88 |
| 6,550,289 | B1 | 4/2003 | Higgins | |
| 6,859,948 | B2 * | 3/2005 | Melts | 2/465 |
| 6,880,268 | B2 * | 4/2005 | Chen | 36/43 |
| 7,028,417 | B2 * | 4/2006 | Tingle | 36/9 R |
| 7,056,299 | B2 | 6/2006 | Brown et al. | |
| D594,221 | S * | 6/2009 | Giardina | D2/980 |
| 7,726,044 | B2 * | 6/2010 | Gray | 36/93 |
| 2001/0047146 | A1 * | 11/2001 | Toda | 602/62 |
| 2003/0055368 | A1 | 3/2003 | Jacoby | |
| 2005/0076421 | A1 * | 4/2005 | Littzi | 2/239 |
| 2005/0086838 | A1 * | 4/2005 | Khantzis | 36/30 R |
| 2006/0253962 | A1 * | 11/2006 | Hua | 2/239 |
| 2007/0271819 | A1 * | 11/2007 | Chen | 36/43 |
| 2008/0189829 | A1 * | 8/2008 | Fusco | 2/239 |
| 2009/0106879 | A1 * | 4/2009 | Post | 2/240 |
| 2009/0113603 | A1 * | 5/2009 | Liu | 2/240 |
| 2009/0193567 | A1 * | 8/2009 | Treptow et al. | 2/239 |
| 2009/0205097 | A1 * | 8/2009 | Manning et al. | 2/22 |
| 2009/0300823 | A1 * | 12/2009 | Connaghan et al. | 2/241 |
| 2010/0050322 | A1 * | 3/2010 | Zagula | 2/239 |
| 2010/0077534 | A1 * | 4/2010 | Gill | 2/239 |
| 2010/0331749 | A1 * | 12/2010 | Powaser | 602/23 |
| 2011/0061148 | A1 * | 3/2011 | Egozi | 2/239 |

FOREIGN PATENT DOCUMENTS

| | | |
|---|---|---|
| KR | 20-03352347 Y1 | 3/2003 |

* cited by examiner

HOSIERY WITH REMOVABLE FOOT CUSHION

TECHNICAL FIELD

The present invention relates generally to hosiery and, more particularly, to footwear hosiery that defines a receptacle and includes a pad configured for removable disposal within the receptacle, whereby the pad is desirably fabricated from a memory foam material.

BACKGROUND OF THE INVENTION

Many people suffer from foot pain and discomfort, which may be due to various factors that may include injury, structural imbalance and excessive activity. These factors lead to various foot conditions such as plantar fascitis, metatarsalgia, bunions, heel pain, as well as blisters, corns and calluses. Various attempts to alleviate foot pain and discomfort have been developed including the use of cushioned hosiery, such as stockings and socks. These known attempts have employed multiple layers, high density terry loop soles and inflatable bladders to provide cushion to the foot. See, for example, U.S. Pat. Nos. 4,277,959 and 5,329,640. These known designs, however, only provide generalized cushioning without furnishing the wearer with the ability to adjust the degree and placement of the cushioning to conform to the wearer's particular needs. In many cases, the inability to adjust the cushioning to these needs fails the intended purpose, which is to alleviate foot pain and discomfort.

Further, such generalized cushioning can be harmful to the wearer. For example, such generalized hosiery designs may not sufficiently conform to the wearer and the hosiery can bunch up or slide about the foot. This can cause additional discomfort and areas of focal pressure. In certain cases, such as those persons having peripheral neuropathy, skin sores can result.

Therefore, it would be desirable to overcome the disadvantages and drawbacks of the prior art with footwear hosiery, which defines a receptacle and includes a pad configured for removable disposal within the receptacle. Desirably, the pad is fabricated from a memory foam material. Most desirably, the hosiery can be adjustable and includes a plurality of alternately sized cushions interchangeably receivable within the receptacle. It is contemplated that the footwear hosiery is easily and efficiently manufactured.

SUMMARY OF THE INVENTION

Accordingly, footwear hosiery is disclosed, which defines a receptacle and includes a pad configured for removable disposal within the receptacle for overcoming the disadvantages and drawbacks of the prior art. Desirably, the pad is fabricated from a memory foam material. Most desirably, the hosiery can be adjustable and includes a plurality of alternatively sized cushions interchangeably receivable within the receptacle. The footwear hosiery may be easily and efficiently manufactured.

The present invention includes memory foam cushioned hosiery with removable memory foam cushions. The footwear hosiery can be a cushioned hosiery product/line in which the hosiery includes a memory foam cushion placed in the mid arch inner bottom portion part of the hosiery. A slip opening is cut to form an insert for the memory foam cushion to be inserted into and removed from a receptacle of the hosiery. The memory cushions are designed to conform to the undersurface portion of the bottom of the foot and/or the upper forefoot portion of the foot. The undersurface portion and the upper forefoot portion can be combined in applications where the arch is devoid and also in applications in which the arch is not devoid. The hosiery may include various design patterns and variations of fabrics used. For example, the hosiery may be incorporated with slow rebound soft high density memory foam to create the memory foam cushioned hosiery with removable and interchangeable foot cushions.

In another embodiment, a pattern is cut from slow rebound soft high density memory foam to form a whole or partial shape of the undersurface portion and/or the upper forefoot portion. The hosiery may include a liner pattern cut from polyester, spandex or any compatible fabric and formed to the shape of the memory foam cushion design pattern and sewn together. A horizontal or vertical slit opening is cut within the mid arch exterior bottom portion of the hosiery to form an opening insert in which the slow rebound soft high density foam cushion can be inserted. The components of the hosiery can be cut in various patterns such as in a loop, zigzag, or flat bed pattern depending on the application. These components may be removable.

The memory foam material can have a firmness, in a range between hard and soft. It is envisioned that the firmness is used in determining comfort as measured by the foam Indentation Force Deflection Rating. The provided scale of firmness of the hosiery provides different levels of comfort to the wearer. The hosiery can include a slow rebound soft high density memory foam that moulds itself in a contouring configuration to a natural form of compression between the foot and the footwear. This configuration provides maximum comfort to the feet.

It is contemplated that the hosiery may be employed with various footwear applications such as, for example, stockings, socks, knee highs, peds, pantyhose, tights, forefoot covers, toeless foot covers, foot sleeves, mules and peep toes. The hosiery may be manufactured from fabrics and memory foam cushion material including slow rebound soft high density memory foam, nylon, spandex, cotton, lycra and polyester. These fabrics and materials can be incorporated and interchanged.

The present invention includes hosiery with removable and interchangeable foot cushions having memory foam material dimensioned for securement to an exterior undersurface portion of the bottom of the foot. A vertical or horizontal cut can be made on the exterior mid arch portion of the undersurface bottom foot portion of the hosiery to form a slit opening. The opening allows the foot cushions to be inserted into and removed from a receptacle of the hosiery. The present invention also includes fine hosiery such as nylon, spandex or a blend thereof or a comparable synthetic stretchable material.

The removable and interchangeable feature of the hosiery allows the wearer to choose the size and shape of the foot cushion, providing a best fit with footwear. The hosiery also provides a sizable opening, which forms a pocket on the exterior mid arch portion of the hosiery facilitating insertion and removal of the foot cushions from the hosiery. The hosiery includes foot cushions dimensioned to the shape of the receptacle of the hosiery.

It is envisioned that the removable and interchangeable foot cushions are dimensioned and vary in thickness and shape. This feature advantageously provides different levels of comfort contouring a natural form of compression between the wearer's foot and footwear. The hosiery can be fabricated from a uniform material extending down the leg and covering the upper forefoot portion of the foot. The interior undersurface of the hosiery can be fabricated from a cotton blend. The exterior undersurface of the hosiery can be fabricated from a reinforced stretchable material.

The present disclosure relates to hosiery and alternate hosiery embodiments with removable and interchangeable foot cushions, which provide comfort to the wearers feet as well as convenience in selecting the shape and size of the foot cushions, which provides the wearer maximum comfort. In one embodiment, a hosiery system is provided with a set of removable and interchangeable foot cushions. Such components are individually configured and correlated.

In another embodiment, the hosiery includes a pair of leg portions and a pair of foot portions extending from the lower ends of the leg portions, a waist portion and a crotch portion. The foot portions each have a receptacle with an opening disposed at the mid arch undersurface portion of the hosiery and/or the upper forefoot portion of the hosiery or both, so that removable and interchangeable foot cushions can be inserted into and removed from the receptacle.

In another embodiment, the hosiery includes a peep toe foot portion with the receptacle described. The peep toe foot portion has a forward open end exposing a partial upper portion of the toes of a wearer. The open end extends from the metatarsal (ball of foot) to the ankle and heel portion.

In another embodiment, the hosiery includes a knee high portion and a foot portion with the receptacle described. The hosiery includes a pair of foot portions, partial leg portions extending from the toe portion to below the knee portion of the leg.

In another embodiment, the hosiery includes a mule foot portion with the receptacle described. The hosiery article covers a partial upper forefoot and undersurface portion of the foot, extending from the toe portion to the mid-arch portion of the foot.

In another embodiment, the hosiery includes a foot portion having a toeless foot stocking. The foot portion has an upper open end with full exposure of the toes. A material strip is sewn between the large toe and the toe next to it for securement of the stocking to the foot. Extending from the lower ends of the toe portion, an undersurface covering extends to the heel portion.

In another embodiment, the hosiery includes a foot portion having a ped stocking. The foot portion has an open upper forefoot portion, a covering of the toe portion and a covering extending from the undersurface toe portion to the undersurface heel portion.

In one particular embodiment, in accordance with the principles of the present disclosure, footwear hosiery is provided. The footwear hosiery includes a first layer defining a front portion, an arch portion and a rear portion. A second layer is connected with at least one of the arch portion and the front portion in a configuration to define a receptacle having an opening. A pad is configured for removable disposal within the receptacle. The first layer may be a fabric material. The second layer may be fabricated from a flexible material.

The footwear hosiery may have a top portion and a bottom portion. The receptacle can be defined adjacent the bottom portion from the arch portion to the front portion of the first layer. The receptacle can be defined adjacent the top portion at a front portion of the first layer. The opening can be defined adjacent a side portion of the first layer.

The pad can be fabricated from a memory foam material. Desirably, the pad is fabricated from a slow rebound, soft, high-density memory foam material. The receptacle may be configured for disposal of alternately configured pads.

In an alternate embodiment, the footwear hosiery has a second flexible layer attached with the first fabric layer in a configuration to define at least one pocket having a receptacle with an opening. The opening is disposed adjacent a mid portion of the foot. A memory foam pad is configured for removable disposal within the at least one pocket. The at least one pocket can be configured for disposal of alternately configured pads. The second flexible layer can be attached with the first flexible layer to define a first pocket adjacent a front portion of the first fabric layer and a second pocket adjacent a rear portion of the first fabric layer, each of the pockets being configured for receipt of a pad.

An opening of the first pocket may be in opposing relation to an opening of the second pocket. The first fabric layer may be disposed in an orientation that defines a toe opening. The first fabric layer may be disposed in an orientation that defines a rear facing opening.

The pad may define an arcuate front end portion and an arcuate rear end portion.

BRIEF DESCRIPTION OF THE DRAWINGS

The above and other objects, features and advantages of the present disclosure will be more readily apparent from the specific description accompanied by the following drawings, in which.

Like reference numerals indicate similar parts-throughout the figures.

DETAILED DESCRIPTION OF THE INVENTION

The exemplary embodiments of the footwear hosiery disclosed are discussed in terms of hosiery and more particularly, in terms of footwear hosiery, which defines a receptacle and includes a pad configured for removable disposal within the receptacle. It is envisioned that the present disclosure may be employed with a range of footwear applications such as, for example, stockings, socks, knee highs, peds, pantyhose, tights, forefoot covers, toeless foot covers, foot sleeves, mules and peep toe designs. The footwear hosiery may be employed for general purpose and therapeutic applications.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
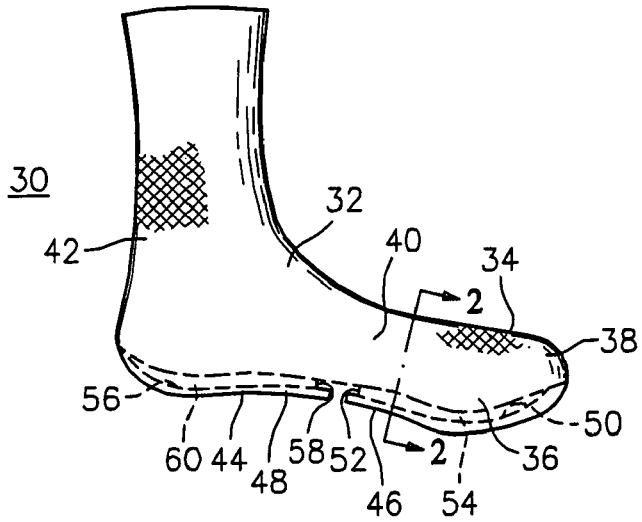
FIG. 1 is a side view of one particular embodiment of footwear hosiery, in accordance with the principles of the present disclosure.
Figure 2:
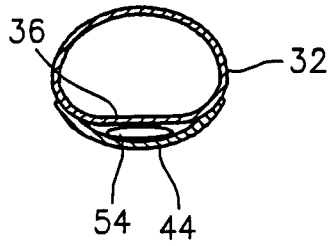
FIG. 2 is a cross-section view of the footwear hosiery shown in FIG. 1 taken along lines 2-2.
Figure 3:
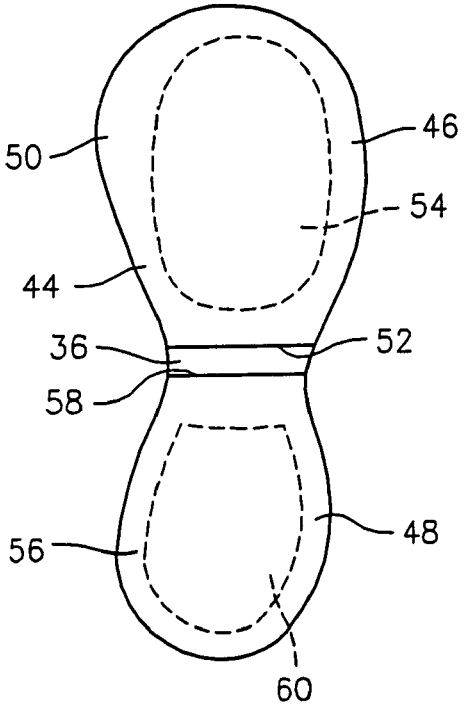
FIG. 3 is a bottom plan view of the footwear hosiery shown in FIG. 1.

The following discussion includes a description of footwear hosiery, related components and exemplary methods of employing the hosiery in accordance with the principles of the present disclosure. Alternate embodiments are also disclosed. Reference will now be made in detail to the exemplary embodiments of the present disclosure, which are illustrated in the accompanying figures. Turning now to FIGS. 1-3, there is illustrated footwear hosiery 30 in accordance with the principles of the present disclosure.

The components of footwear hosiery 30 are fabricated from materials suitable for hosiery and garment applications, including fabrics of natural and synthetic materials such as, for example, nylon, spandex, cotton, silk, lycra and polyester or blends thereof, woven materials such as felt, non-woven materials including non-woven spunbond or carded webs of polypropylene, polyethylene, nylon, polyester, a non-woven web of cellulosic fibers, textile fibers such as rayon fibers, or a blend of cellulosic and textile fibers; or melt blown thermoplastic fibers, such as macro fibers or micro fibers of polypropylene, polyethylene, polyester or other thermoplastic materials or mixtures of such thermoplastic macro fibers or micro fibers with cellulosic, pulp or textile fibers, and natural fibers (e.g., wood or cellulose), may be used depending on the particular application. One skilled in the art, however, will realize that other materials suitable for manufacture, in accordance with the present disclosure would be appropriate.

Footwear hosiery 30 has a sock or stocking configuration and is designed for disposal about a foot and/or ankle of a wearer (not shown). Footwear hosiery 30 has a first fabric layer 32 configured for disposal about the foot of a wearer, and defines a top portion 34 and a bottom portion 36. First fabric layer 32 further defines a front portion 38 that covers the ball and toes of the foot, an arch portion 40 that covers the mid and arch region and a rear portion 42, which covers the heel and extends above the ankle.

It is contemplated that first layer 32 may include a single layer or be fabricated from a laminate of multiple layers. In an embodiment including multiple layers, it is further contemplated that the multiple layers may include the same or alternative materials. It is envisioned that first layer 32 may cover all or only a portion of the foot, and alternatively cover the foot and additional portions of the wearer, such as the leg, crotch and waist area. It is further envisioned that first layer 32 may be fabricated from a non-fabric material such as rubber or other polymers. The first layer 32 can be treated to render it hydrophilic or hydrophobic, and/or may be coated with anti-fungal and/or anti-microbial materials. First layer 32 may include a liner attached thereto or disposed therewith for engagement with the foot.

A second flexible layer 44 is connected with bottom portion 36 in a configuration to define a first pocket 46 and a second pocket 48. It is contemplated that second layer 44 may include a single layer or be fabricated from a laminate of multiple layers. In an embodiment including multiple layers, it is further contemplated that the multiple layers may include the same or alternative materials. It is further envisioned that second layer 44 may be fabricated from an elastic material or a flexible fabric material. The second layer 44 can be treated to render it hydrophilic or hydrophobic, and/or may be coated with anti-fungal and/or anti-microbial materials. Second layer may include a reinforced stretchable material sewn to first layer 32.

First pocket 46 is connected to bottom portion 36 adjacent front portion 38 and arch portion 40, and defines a receptacle 50 having an opening 52. Receptacle 50 is configured for receipt of a pad 54, which alleviates foot pain and discomfort, as will be discussed in more detail below. First pocket 46 may be monolithically formed with bottom portion 36 or integrally connected therewith. First pocket 46 may be attached to bottom portion 36 via heat treating, adhesive, and/or sewn, or fabricated as one component of footwear hosiery 30. Opening 52 is disposed transversly across bottom portion 36. It is contemplated that opening 52 may be disposed longitudinally across bottom portion 36, may be discontinuous or extend across only a portion of bottom portion 36.

Pad 54 is configured for removable disposal within receptacle 50. As such, footwear hosiery 30 provides cushioning and is configured to alleviate foot pain and discomfort by furnishing the wearer with the ability to adjust the degree and placement of the cushioning with interchangeable pads to conform to the wearer's particular needs. Pad 54 provides cushioning and is configured to conform to the wearer's mid/arch region and bottom/front portion of the foot including the ball and toes. Footwear hosiery 30 can be employed with one or a plurality of alternatively sized pads 54, each configured for removable disposal within receptacle 50. Each of the pads 54 can have alternate sizes, shapes and relative degrees of cushioning properties, preferably in a range from soft to hard, according to the needs of the wearer.

It is envisioned that pad 54 and the corresponding portion of first layer 32 may be configured and dimensioned to engage both, one, portions of both or only a portion of either of the mid/arch region and bottom/front portion of the foot. It is contemplated that pad 54 is fabricated from a memory foam material including those fabricated from urethane and slow rebound soft high density memory foams. Pad 54 may alternatively be fabricated from cotton padding, elastic material, rigid or semi-rigid materials, and blends thereof. Pad 54 can include a single layer or be fabricated from a laminate of multiple layers. Pad 54 can be treated to render it hydrophilic or hydrophobic, and/or may be coated with anti-fungal and/or anti-microbial materials.

Second pocket 48 is connected to bottom portion 36 adjacent rear portion 42 and arch portion 40, and defines a receptacle 56 having an opening 58. Receptacle 56 is configured for receipt of a pad 60, which alleviates foot pain and discomfort. Second pocket 48 may be monolithically formed with bottom portion 36 or integrally connected therewith. Second pocket 48 may be attached to bottom portion 36 via heat treating, adhesive, and/or sewn, or fabricated as one component of footwear hosiery 30. Opening 58 is disposed transversly across bottom portion 36. It is contemplated that opening 58 may be disposed longitudinally across bottom portion 36, may be discontinuous or extend across only a portion of bottom portion 36.

Pad 60 is configured for removable disposal within receptacle 56, such that footwear hosiery 30 provides cushioning and adjustment with interchangeable pads, similar to pad 54. Pad 60 provides cushioning and is configured to conform to the wearer's mid/arch region and bottom/rear portion of the foot including the heel. Footwear hosiery 30 can be employed with one or a plurality of alternatively sized pads 60, each configured for removable disposal within receptacle 56. Each of the pads 60 can have alternate sizes, shapes and relative degrees of cushioning properties, preferably in a range from soft to hard, according to the needs of the wearer.

It is envisioned that pad 60 and the corresponding portion of first layer 32 may be configured and dimensioned to engage both, one, portions of both or only a portion of either of the mid/arch region and bottom/rear portion of the foot. It is contemplated that pad 60 may be fabricated from similar or alternative materials to pad 54. Pad 60 can include a single layer or be fabricated from a laminate of multiple layers. Pad 60 can be treated to render it hydrophilic or hydrophobic, and/or may be coated with anti-fungal and/or anti-microbial materials.

It is contemplated that footwear hosiery 30 may include both pad 54 and pad 60, only one of pad 54 or pad 60, or a plurality of pads similar to pad 54, 60 disposed in pockets about first layer 32.

Figure 4:
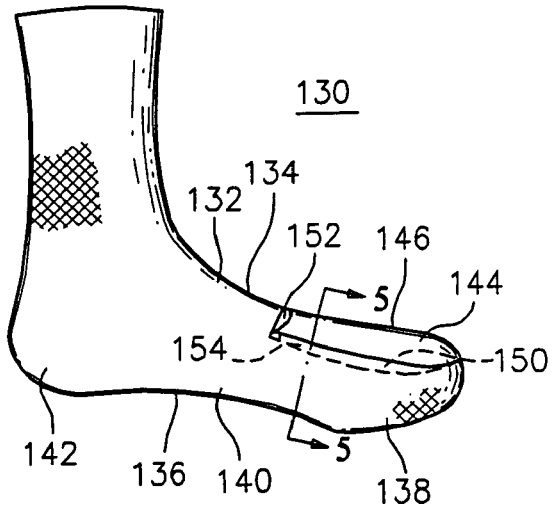
FIG. 4 is a side view of an alternate embodiment of the footwear hosiery shown in FIG. 1.
Figure 5:
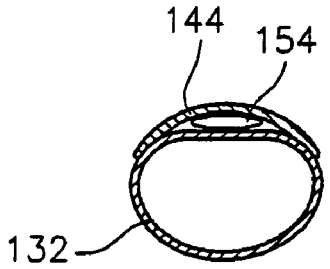
FIG. 5 is a cross section view of the footwear hosiery shown in FIG. 4 taken along lines 5-5.

Referring to FIGS. 4 and 5, in an alternate embodiment, a footwear hosiery 130 is provided, similar to footwear hosiery 30 and its components described with regard to FIGS. 1-3. Footwear hosiery 130 has a first fabric layer 132 configured for disposal about the foot of a wearer, and defines a top portion 134 and a bottom portion 136. First fabric layer 132 further defines a front portion 138 that covers the ball and toes of the foot, an arch portion 140 that covers the mid and arch region and a rear portion 142, which covers the heel and extends above the ankle.

A second flexible layer 144 is connected with top portion 134 in a configuration to define a first pocket 146. First pocket 146 is connected to top portion 134 adjacent front portion 138 and arch portion 140, and defines a receptacle 150 having an opening 152. Receptacle 150 is configured for receipt of a pad 154, which alleviates foot pain and discomfort. First pocket 146 may be monolithically formed with top portion 134 or integrally connected therewith. First pocket 146 may be attached to top portion 134 via heat treating, adhesive, and/or sewn, or fabricated as one component of footwear hosiery 130. Opening 152 is disposed transversly across top portion 134. It is contemplated that opening 152 may be disposed longitudinally across top portion 134, may be discontinuous or extend across only a portion of top portion 134.

Pad 154 is configured for removable disposal within receptacle 150. Pad 154 provides cushioning and is configured to conform to the wearer's mid/arch region and top/front portion of the foot. Footwear hosiery 130 can be employed with one or a plurality of alternatively sized pads 154, each configured for removable disposal within receptacle 150.

It is envisioned that pad 154 and the corresponding portion of first layer 132 may be configured and dimensioned to engage both, one, portions of both or only a portion of either of the mid/arch region and top/front portion of the foot.

Figure 6:
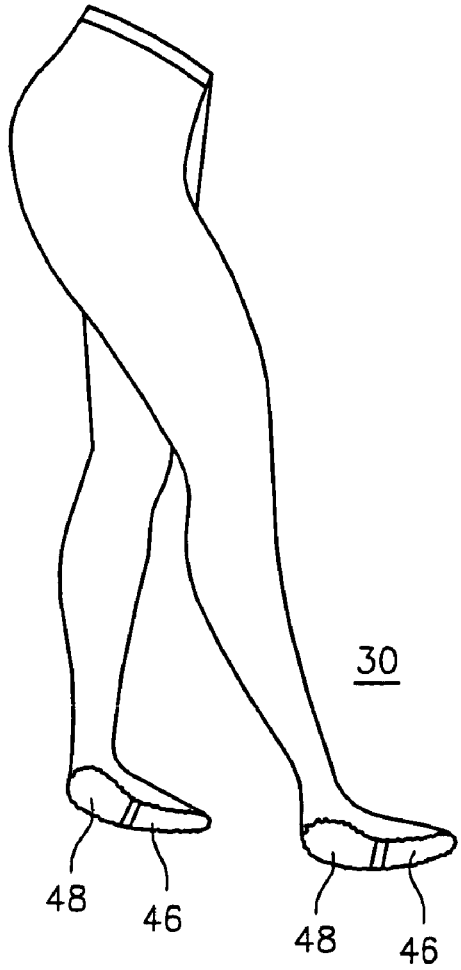
FIG. 6 is a perspective view of an alternate embodiment of footwear hosiery, in accordance with the principles of the present disclosure.

Referring to FIG. 6, in an alternate embodiment, footwear hosiery 30, described above with regard to FIGS. 1-3, includes a stocking that covers the thighs and waist area.

Figure 7:
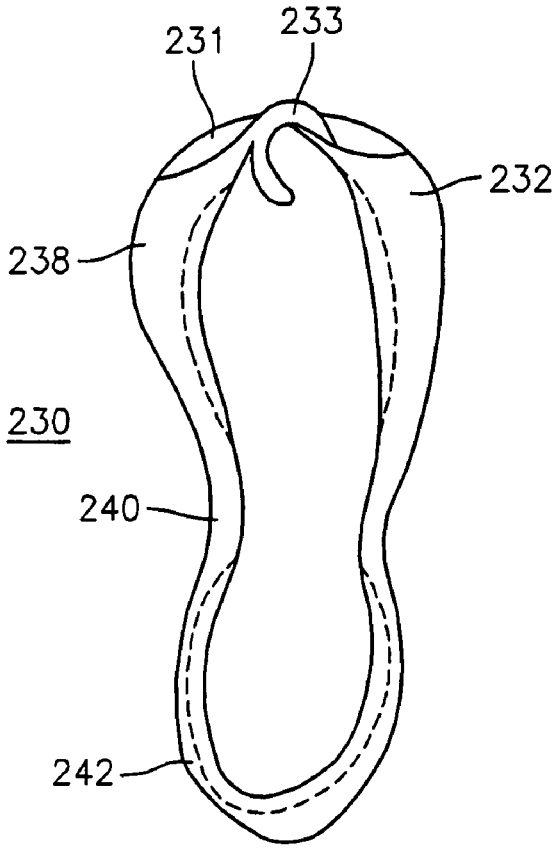
FIG. 7 is a top view of an alternate embodiment of the footwear hosiery shown in FIG. 1.
Figure 8:
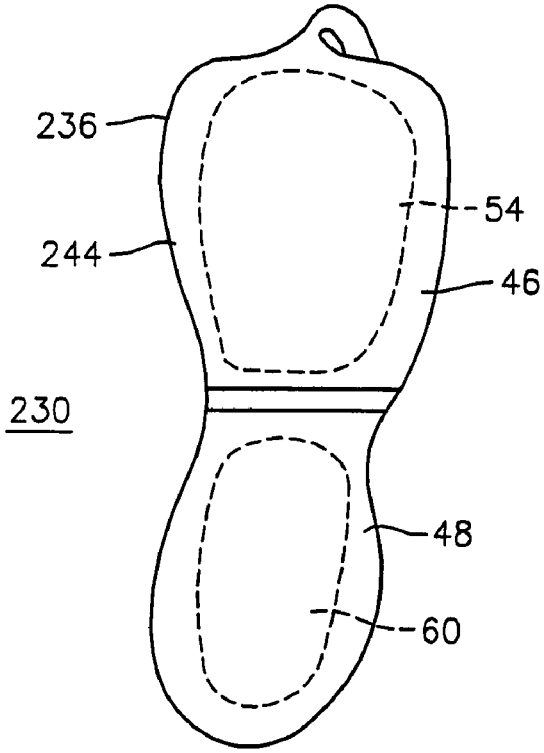
FIG. 8 is a bottom plan view of the footwear hosiery shown in FIG. 7.

Referring to FIGS. 7 and 8, in an alternate embodiment, a footwear hosiery 230 is provided, similar to footwear hosiery 30 and its components described with regard to FIGS. 1-3. Footwear hosiery 230 is a toeless foot stocking having a toeless upper forefoot opening 231 with material 233 sewn therein for disposal between the toes for securement on the foot. Footwear hosiery 230 has a first fabric layer 232 configured for disposal about the foot of a wearer, and defines a bottom portion 236. First fabric layer 232 further defines a front portion 238 that covers the ball and at least a portion of the toes of the foot, a mid portion 240 that covers the mid and arch region and a rear portion 242, which covers at least the heel.

A second flexible layer 244 is connected with bottom portion 236 in a configuration to define pockets 46, 48 configured for receipt of a pads 54, 60, as described above with regard to FIGS. 1-3, which alleviate foot pain and discomfort.

Figure 9:
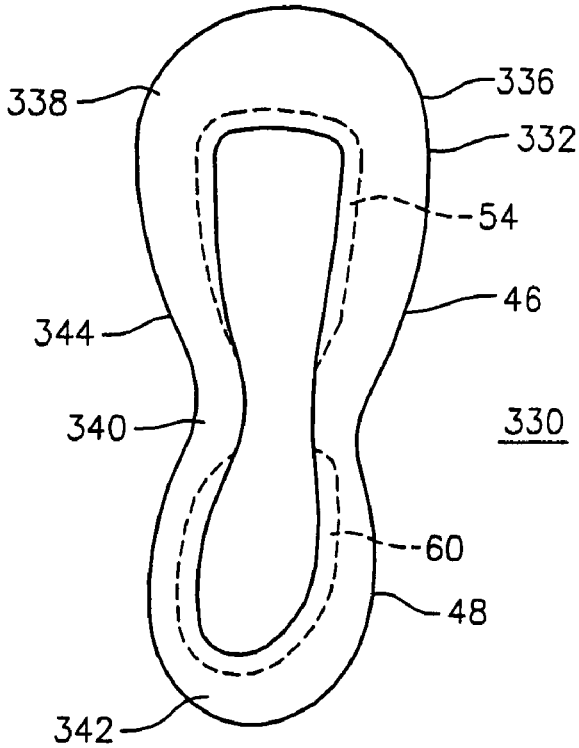
FIG. 9 is a top view of another alternate embodiment of the footwear hosiery shown in FIG. 1.

Referring to FIG. 9, in an alternate embodiment, a footwear hosiery 330 is provided, similar to footwear hosiery 30 and its components described with regard to FIGS. 1-3. Footwear hosiery 330 is a ped stocking for securement on the foot. Footwear hosiery 330 has a first fabric layer 332 configured for disposal about the foot of a wearer, and defines a bottom portion 336. First fabric layer 332 further defines a front portion 338 that covers the ball and at least a portion of the toes of the foot, a mid portion 340 that covers the mid and arch region and a rear portion 342, which covers at least the heel.

A second flexible layer 344 is connected with bottom portion 336 in a configuration to define pockets 46, 48 configured for receipt of a pads 54, 60, as described above with regard to FIGS. 1-3, which alleviate foot pain and discomfort.

Figure 10:
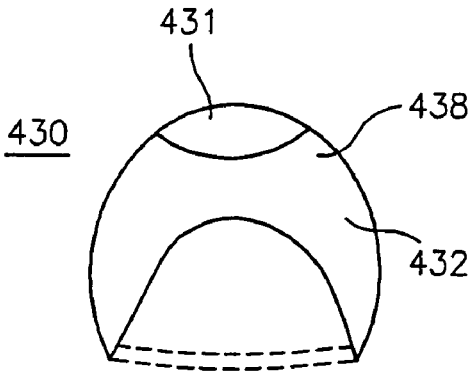
FIG. 10 is a top view of another alternate embodiment of the footwear hosiery shown in FIG. 1.
Figure 11:
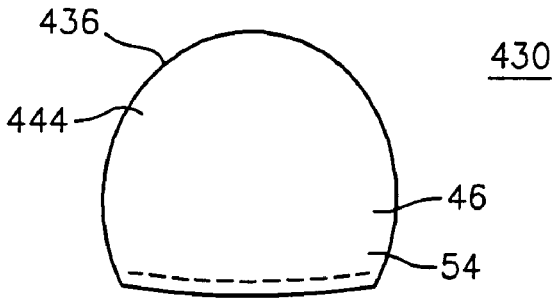
FIG. 11 is a bottom plan view of the footwear hosiery shown in FIG. 10.

Referring to FIGS. 10 and 11, in an alternate embodiment, a footwear hosiery 430 is provided, similar to footwear hosiery 30 and its components described with regard to FIGS. 1-3. Footwear hosiery 430 is a peep toe foot stocking having a toeless upper forefoot opening 431 for securement on the foot. Footwear hosiery 430 has a first fabric layer 432 configured for disposal about the front portion of the foot of a wearer, and defines a bottom portion 436. First fabric layer 432 further defines a front portion 438 that covers the ball and at least a portion of the toes of the foot.

A second flexible layer 444 is connected with bottom portion 436 in a configuration to define pocket 46 configured for receipt of a pad 54, as described above with regard to FIGS. 1-3, which alleviates foot pain and discomfort.

Figure 12:
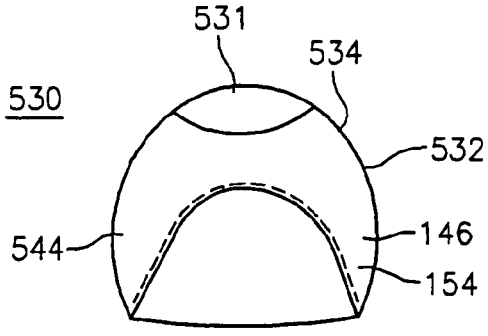
FIG. 12 is a top view of another alternate embodiment of the footwear hosiery shown in FIG. 1.

Referring to FIG. 12, in an alternate embodiment, a footwear hosiery 530 is provided, similar to footwear hosiery 130 and its components described with regard to FIGS. 4 and 5. Footwear hosiery 530 is a peep toe foot stocking having a toeless upper forefoot opening 531 for securement on the foot. Footwear hosiery 530 has a first fabric layer 532 configured for disposal about the front portion of the foot of a wearer, and defines a top portion 534.

A second flexible layer 544 is connected with top portion 534 in a configuration to define first pocket 146 configured for receipt of pad 154, as described above with regard to FIGS. 4 and 5, which alleviates foot pain and discomfort.

Figure 13:
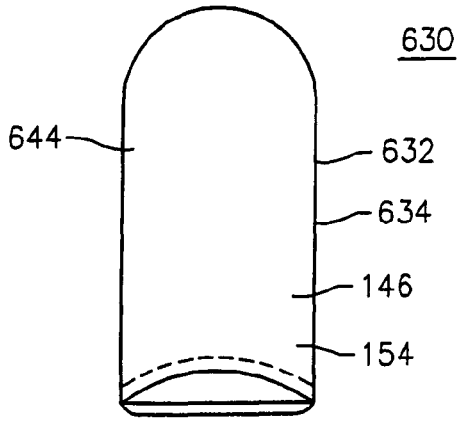
FIG. 13 is a top view of another alternate embodiment of the footwear hosiery shown in FIG. 1.

Referring to FIG. 13, in an alternate embodiment, a footwear hosiery 630 is provided, similar to footwear hosiery 130 and its components described with regard to FIGS. 4 and 5. Footwear hosiery 630 is a mule design stocking for securement on the foot. Footwear hosiery 630 has a first fabric layer 632 configured for disposal about the front portion of the foot of a wearer, and defines a top portion 634.

A second flexible layer 644 is connected with top portion 634 in a configuration to define first pocket 146 configured for receipt of pad 154, as described above with regard to FIGS. 4 and 5, which alleviates foot pain and discomfort.

Figure 14:
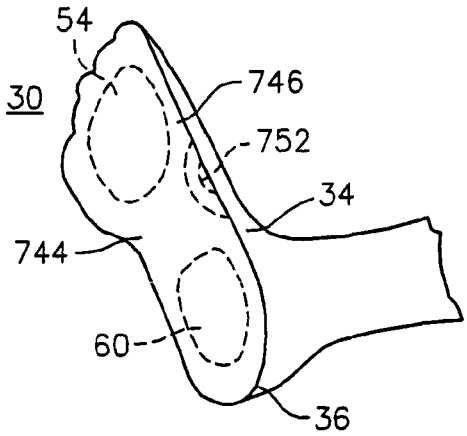
FIG. 14 is a side perspective view of another alternate embodiment of the footwear hosiery shown in FIG. 1.

Referring to FIG. 14, in an alternate embodiment, footwear hosiery 30, described above with regard to FIGS. 1-3. A second flexible layer 744 is connected with top portion 34 in a configuration to define a single pocket 746, which is disposed across bottom portion 36. Pocket 746 has a lateral opening 752 configured for receipt of pads 54, 60, described above, which alleviate foot pain and discomfort.

Figure 15:
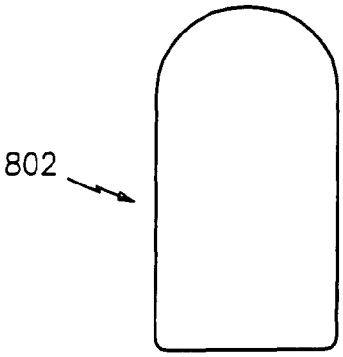
FIGS. 15-21 are plan views of alternate embodiments of a pad of the footwear hosiery.
Figure 16:
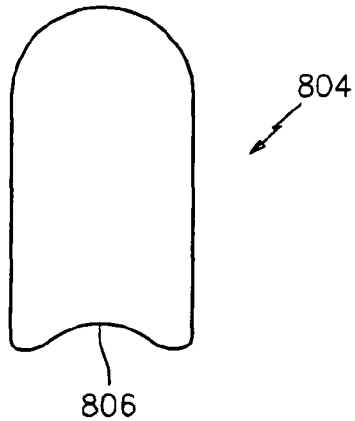
Figure 18:
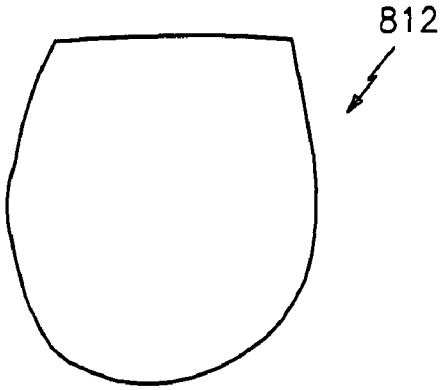
Figure 19:
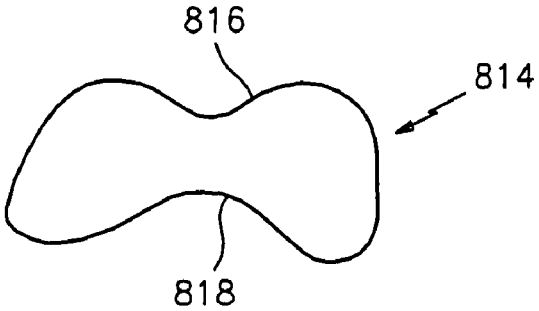
Figure 17:
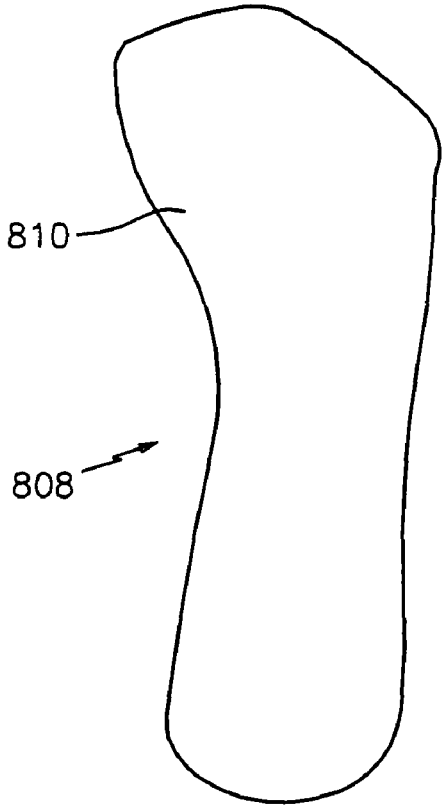
Figure 20:
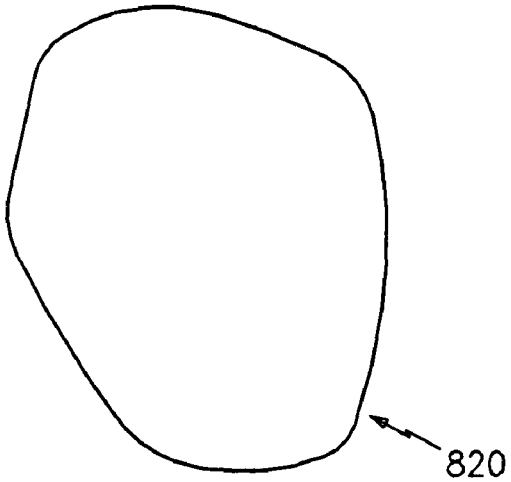
Figure 21:
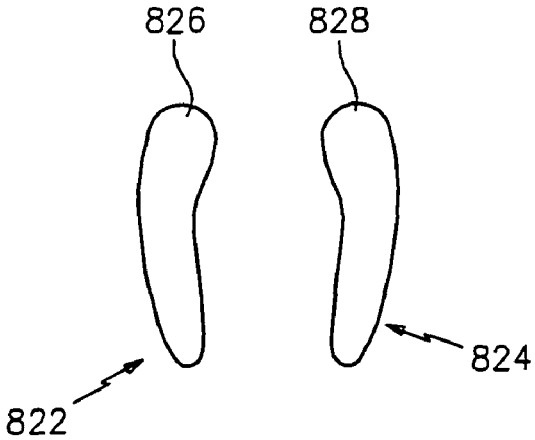

Referring to FIGS. 15-21, the footwear hosiery disclosed can include alternate embodiments of pad 54 and/or pad 60, similar to those described above, configured for removable disposal within a receptacle of the footwear hosiery. As shown in FIG. 15, a pad 802 is configured for employment with a pocket having a mule design. As shown in FIG. 16, a pad 804 is configured for employment with a pocket having a mule design. Pad 804 has an arcuate base portion 806. As shown in FIG. 17, a pad 808 is configured for employment with an elongated pocket having an irregular front portion 810. As shown in FIG. 18, a pad 812 is configured for employment with a pocket having a peep toe design. As shown in FIG. 19, a pad 814 is configured for employment with a pocket having a peep toe design. Pad 814 includes undulating end portions 816, 818. As shown in FIG. 20, a pad 820 is configured for employment with a pocket and has an irregular configuration. As shown in FIG. 21, left and right foot pads 822, 824 are each configured for employment with an elongated pocket having an irregular front portions 826, 828 respectively.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. Footwear hosiery comprising:

a first layer configured for disposal about at least a top surface, a side surface and a bottom surface of a foot and defining a top portion having an opening, a bottom portion, a front portion, an arch portion and a rear portion, the portions defining a cavity configured for disposal of the foot;

a second layer connected with the rear portion, the arch portion and the front portion in a configuration to define a first pocket disposed adjacent the front portion and the arch portion, the first pocket including a receptacle and a second pocket disposed adjacent the rear portion and the arch portion, the second pocket including a receptacle, the second layer further defining an opening configured to provide access to the receptacles;

a first cushion pad configured to conform to at least a portion of an arch region and a front portion of a foot, and for removable disposal within the receptacle of the first pocket; and a second cushion pad being separate from the first cushion pad, the second cushion pad configured to conform to at least a portion of the arch region and a rear portion of the foot, and for removable disposal within the receptacle of the second pocket, wherein at least one of the first cushion pad and the second cushion pad defines a hydrophobic surface that engages the bottom portion of the first layer, wherein at least one of the pads is fabricated from a memory foam material.

2. Footwear hosiery according to claim 1, wherein the first layer is a reinforced stretch fabric material.

3. Footwear hosiery according to claim 1, wherein the second layer is fabricated from a flexible material.

4. Footwear hosiery according to claim 1, wherein at least one of the pads is fabricated from a slow rebound, soft, high-density memory foam material.

5. Footwear hosiery according to claim 1, wherein each of the receptacles is configured for disposal of alternately configured pads, the alternately configured pads being interchangeable such that the footwear hosiery is configured to provide adjustable cushioning.

6. Footwear hosiery comprising:

a first fabric layer configured for disposal about at least a top surface, a side surface and a bottom surface of a foot, and defining a top portion having an opening, a bottom portion and a side portion, the portions defining a cavity configured for disposal of the foot;

a second flexible layer attached with the first fabric layer in a configuration to define a first pocket having a receptacle and a second pocket having a receptacle, the first pocket being disposed adjacent at least a portion of an arch region and a front portion of the foot and the second pocket being disposed adjacent at least a portion of the arch region and a rear portion of the foot, the second layer further defining an opening being disposed adjacent a mid portion of the foot;

a first memory foam pad configured to conform to at least a portion of the arch region and the front portion of the foot and for removable disposal within the receptacle of the first pocket; and a second memory foam pad configured to conform to at least a portion of the arch region and the rear portion of the foot and for removable disposal within the receptacle of the second pocket.

7. Footwear hosiery according to claim 6, wherein each of the receptacles is configured for disposal of alternately configured pads, the alternately configured pads being interchangeable such that the footwear hosiery is configured to provide adjustable cushioning.

8. Footwear hosiery according to claim 6, wherein the first fabric layer is disposed in an orientation that defines a rear facing opening.

9. Footwear hosiery according to claim 6, wherein at least one of the pads is hydrophobic.

10. Footwear hosiery comprising:

a first fabric layer configured for disposal about at least a top surface, a side surface and a bottom surface of a foot and defining a top portion having an opening, a bottom portion, a front portion, a mid-arch portion and a rear bottom portion, the portions defining a cavity configured for disposal of the foot;

a second flexible layer connected to the first layer to define at least a first pocket and a second pocket, the first pocket being connected adjacent the front portion and defining a receptacle having an opening, the second pocket being connected adjacent the rear portion and defining a receptacle having an opening;

a first cushion pad configured to conform to at least a portion of an arch region and a front portion of the foot, and for removable disposal within the receptacle of the first pocket; and a second cushion pad configured to conform to at least a portion of the arch region and a rear portion of the foot, and for removable disposal within the receptacle of the second pocket, wherein at least one of the first cushion pad and the second cushion pad are formed of a single hydrophobic layer that engages the bottom portion of the first layer.

11. Footwear hosiery according to claim 10, wherein the cushion pads are fabricated from a memory foam material.

12. Footwear hosiery according to claim 11, wherein each of the receptacles is configured for disposal of alternately configured pads, the alternately configured pads being interchangeable such that the footwear hosiery is configured to provide adjustable cushioning.

13. Footwear hosiery according to claim 10, wherein the pads are elastic and hydrophobic.

14. Footwear hosiery according to claim 1, wherein the at least one of the first cushion pad and the second cushion pad that define a hydrophobic surface is formed of a single layer.

* * * * *